US011430580B2

(12) United States Patent
Maciocco et al.

(10) Patent No.: US 11,430,580 B2
(45) Date of Patent: Aug. 30, 2022

(54) NEUTRON ACTIVATOR INCLUDES A METALLIC PLATE TARGET CONFIGURED TO PRODUCE PROTONS THROUGH INTERACTION WITH A PROTON BEAM AND METHOD OF USE

(71) Applicant: ADVANCED ACCELERATOR APPLICATIONS, Saint Genis Pouilly (FR)

(72) Inventors: Luca Maciocco, Crozet (FR); Ilyes Zahi, Nantes (FR)

(73) Assignee: ADVANCED ACCELERATOR APPLICATIONS, Saint Genis Pouilly (FR)

( * ) Notice: Subject to any disclaimer, the term of this patent is extended or adjusted under 35 U.S.C. 154(b) by 0 days.

(21) Appl. No.: 16/973,085

(22) PCT Filed: Jul. 5, 2019

(86) PCT No.: PCT/EP2019/068058
§ 371 (c)(1),
(2) Date: Dec. 8, 2020

(87) PCT Pub. No.: WO2020/011654
PCT Pub. Date: Jan. 16, 2020

(65) Prior Publication Data

US 2021/0257121 A1 Aug. 19, 2021

(30) Foreign Application Priority Data

Jul. 9, 2018 (EP) ..... 18305902

(51) Int. Cl.
*G21G 1/06* (2006.01)
*G21K 5/08* (2006.01)

(52) U.S. Cl.
CPC *G21G 1/06* (2013.01); *G21K 5/08* (2013.01)

(58) Field of Classification Search
CPC ..... G21G 1/06; G21K 5/08
USPC ..... 376/158, 202
See application file for complete search history.

(56) References Cited

U.S. PATENT DOCUMENTS

2017/0251547 A1 8/2017 Ito
2020/0126683 A1* 4/2020 Maciocco ..... G21G 1/06

FOREIGN PATENT DOCUMENTS

GB 2 487 198 7/2012
WO 98/59347 12/1998
WO 2016/037656 3/2016

* cited by examiner

*Primary Examiner* — Jack W Keith
*Assistant Examiner* — Daniel Wasil
(74) *Attorney, Agent, or Firm* — Clark & Brody LP

(57) ABSTRACT

A neutron activator includes a neutron source and a reflector-moderator. The neutron source has a housing extending along a longitudinal axis (B). A metallic target as part of the neutron source is provided to produce neutrons through the interaction with a proton beam, the metallic target having a plurality of plates arranged transversally with respect to the longitudinal axis (B). The neutron source also includes a cooling circuit to cool the metallic target. The reflector-moderator has an activation area configured to accommodate the neutron source and the material to be activated.

22 Claims, 2 Drawing Sheets

NEUTRON ACTIVATOR INCLUDES A METALLIC PLATE TARGET CONFIGURED TO PRODUCE PROTONS THROUGH INTERACTION WITH A PROTON BEAM AND METHOD OF USE

TECHNICAL FIELD

The invention relates to a neutron activator, a neutron activation system comprising such neutron activator and a method for neutron activation implementing such neutron activator.

Although not limited thereto, the invention applies to activation of doses of injectable product, possibly injectable, through the production of a suitable neutron field.

The invention particularly relates to a neutron activator for production of radioisotopes of interest, which operating principle is based on the interaction of a proton beam with a solid target, which generates neutrons that are then moderated/reflected in a solid assembly to obtain a favourable neutron spectrum for the (n, γ) reactions in the isotopes of interest (for example $^{165}$Ho, and $^{176}$Lu). This neutron activator is suitable for receiving a proton beam of energy comprised between about 16 MeV and about 30 MeV and a proton intensity above 1 mA and up to 1.5 mA.

BACKGROUND ART

Treatment of cancer tumours is based on three main therapeutic classes (frequently combined for increasing the chances of recovery): surgery, chemotherapy and external radiotherapy.

Brachytherapy or "in situ" radiotherapy is often recommended in addition to surgery or chemotherapy (as in breast or cervical tumors), or in alternative, constituting then the exclusive first-line treatment (as in prostate cancer in US, treatment of hepatocarcinomas, or other hepatic tumors).

Rapidly dividing cells are particularly sensitive to damage by radiation. For this reason, some cancerous growths can be controlled or eliminated by administering or planting a small radiation source, usually a gamma or beta emitter, in the target area.

The main advantage of brachytherapy procedures is that they give less overall radiation to the body, minimising the exposure of healthy tissues, are more localized to the target tumor and are cost-effective.

$\beta^-$-emitting radioisotopes can be produced through neutron irradiation of the corresponding stable isotopes.

Currently such isotopes are produced only in research nuclear reactors, but the main disadvantages rely on the low availability of reactors in Europe for medical use, combined with tight schedule and ageing problems.

Consequently, a need still exists to improve the methods for the efficient production of neutron-activated radioisotopes using cyclotrons for medical applications.

One of the objects of the present disclosure is to propose an alternative to the production of radioisotopes for medical use, in nuclear reactors.

Another object is to improve the efficiency of the method of production of radioisotopes for medical use.

Another object of the invention is to provide a device and a method for neutron activation of a material, for producing radioisotopes.

WO 98/59347 discloses that a material exposed to a neutron flux by distributing it in a neutron-diffusing medium surrounding a neutron source can be used to produce useful radio-isotopes, in particular for medical applications, from the transmutation of readily-available isotopes included in the exposed material. The neutron source consists of a beryllium or lithium target bombarded with a charged particle beam.

A major drawback of this method is that the dimensions of the activator are very big in order to contain the neutrons within the system during their elastic-scattering path in the material. This also results in a relevant dilution of the neutron flux, in particular at lower energies (so after several scattering interactions).

WO 2016/037656 discloses a method and an activator that enhances captures in the resonance region. The strength of the flux of neutrons is optimized by reflectors and/or moderators.

With respect to WO 98/59347, it proposes some general approaches aiming at reducing the activator size while exploiting the neutron-elastic-scattering properties of lead, and therefore the Adiabatic Resonance Crossing principle in the activation area. But this approach is not the most efficient to activate the considered isotopes.

An improved system compared to the activator disclosed in WO 98/59347 and WO 2016/037656 has been proposed in the pending patent application EP 17 305 461.0 in the name of the applicant. This patent application describes a neutron activator comprising:

- a neutron source comprising a metallic target suitable for receiving a proton beam of energy comprised between 16 MeV and 100 MeV, and capable of sustaining proton intensities up to 1 mA,
- a Beryllium first reflector-moderator peripheral to the neutron source and comprising the neutron activation area,
- and optionally, a second reflector-moderator embedding said Beryllium first reflector-moderator.

For proton beam of low energy, namely from about 16 MeV to about 30 MeV, in order to maintain convenient performances for the aimed activation process, high proton intensities are needed, in particular above 1 mA and up to 1.5 mA. At these high proton intensities, high mechanical stresses are induced on the metallic target by the thermal stresses.

There is a need for an improved neutron activator able to durably withstand high proton intensities.

By an innovating manner, the inventors have put in evidence that a specific design of this target could solve this problem. They have developed a new target design showing improved thermal and mechanical performances.

SUMMARY OF THE DISCLOSURE

These and other objects are achieved by the presently disclosed invention which proposes, in a first aspect, a neutron activator for neutron activation of a material which comprises:

a neutron source comprising:

a housing extending along a longitudinal axis intended to be arranged parallel, especially coaxial, to the beam axis, the housing presenting an opening through which the proton beam may enter the neutron source, and a metallic target configured to produce neutrons through the interaction with the proton beam, the target comprising at least one plate, preferably made of a material comprising Beryllium and/or Tantalum, arranged transversally, in particular perpendicularly, with respect to the longitudinal axis, the plate presenting an upstream surface directed towards the opening of the housing and a downstream surface opposite the upstream surface, a cooling circuit configured to cool the metallic target, a first reflector-moderator preferably made of a material comprising Beryllium and including an activation area configured to accommodate the neutron source and the material to be activated.

The metallic target may comprise a plurality of adjacent plates arranged parallel to each other and centered on the longitudinal axis.

Said at least one plate of the metallic target may be a disk having a circular contour.

Said at least one plate of the metallic target may be curvated, the upstream surface being convex and the downstream surface being concave.

The use of curvated plates in place of flat ones will reduce potential damages coming from mechanical deformation stresses induced by the cooling fluids pressure, the accelerator vacuum (for the first plate) and the thermomechanical deformation resulting from energy deposited by the proton beam.

The thickness of each plate may be optimized as that the stresses generated by the temperature gradients remain within the elastic limit, and where the number of plates results in the protons to be completely stopped just after an end plate facing an end wall of the housing in a cooling media, preferably water, where neutron production and moderation would occurred.

In a specific embodiment, the number of plates, their thickness and/or their radius of curvature may be optimized so that:

(i) part of the protons received from the proton beam have sufficient energy to release a fraction of it incident energy into each plate until the end plate considering the beam entrance and then release the thermal energy of the Bragg peak outside the target in an end coolant fluid phase, (ii) the power density inside the target is reduced to at least 50% as compared to the power density in a target where all the protons received from the proton beam release their thermal energy inside the target, and (iii) the number of generated neutrons in the target is at least 70% equal to the number of generated neutrons in a target having a thickness where all the protons received from the proton beam release their thermal energy inside the target.

Alternatively, the thicknesses of the target plate may be optimized so that:

(i) the protons received from the proton beam lose all their energy within the metallic target, and (ii) the stresses generated by the temperature gradients in each target plate remain within the elastic limit of the metallic target, while still keeping the cooling liquid temperature flowing onto the surface of the end plate below the boiling point.

In particular, said at least one plate of the metallic target may have a transverse dimension measured perpendicularly to the longitudinal axis, preferably comprised between 30 mm and 60 mm, and a radius of curvature of at least half the transverse dimension.

Said radius of curvature is being optimized in order to guarantee efficient cooling fluids transfer and convenient material manufacturing Said at least one plate of the metallic target may have a thickness measured between the upstream and downstream surfaces comprised between 50 μm and 1 mm.

Alternatively, the metallic target and the proton beam are made to rotate with respect to one another around a central axis of the plate in order to dilute the power density in the target disks.

The cooling circuit may be configured to circulate a flow of cooling fluid transversally with respect to the longitudinal axis along at least the downstream surface of the plate of the metallic target.

The housing of the neutron source may comprise a lateral wall extending around the longitudinal axis between a first end defining the opening and a second end opposite the first end, and an end wall extending transversally with respect to the longitudinal axis at the second end of the lateral wall, the cooling circuit being configured to circulate a flow of liquid, preferably water, as cooling fluid between the end wall of the housing and the downstream surface of the plate facing the end wall.

When the metallic target comprises a plurality of adjacent plates, the cooling circuit may be configured to circulate a flow of gas, preferably helium, as cooling fluid between the downstream and upstream surfaces facing each other of respective adjacent plates.

In a specific embodiment, the target may cooled by a flow of gas, preferably helium, at a static pressure comprised between 1 bar and 10 bars and reaching, near the surfaces of the plates, speeds comprised between 200 m/s and 500 m/s between each plate. For the end plate, the downstream surface may be cooled by a flow of liquid, preferably water, at a static pressure comprised between 1 bar and 20 bars and reaching, near the downstream surface, speeds comprised between 8 m/s and 60 m/s The activation area of the first reflector-moderator may comprise:

a bore extending along a bore axis and configured to accommodate the neutron source so that the bore axis and the longitudinal axis are coaxial, and at least one activation channel extending along a channel axis parallel to the bore axis at the vicinity of the bore, the activation channel being configured to load the material to be activated.

In particular, the activation area may comprise a plurality of activation channels distributed around the bore.

The neutron activator may further comprise a second reflector-moderator housing the first reflector-moderator.

Typically, said first reflector-moderator and, optionally, said second reflector-moderator, may not exceed the volume of a cube of 1 meter side, preferably 0.75 meter side, and for example 0.50 meter side.

According to a second aspect, the invention proposes a neutron activation system for neutron activation of a material, comprising:

a generator configured to produce a proton beam along a beam axis, the proton beam having an energy comprised between about 16 MeV and about 30 MeV, preferably of about 30 MeV, and a proton intensity above 1 mA and up to 1.5 mA, a neutron activator as defined previously arranged so that the longitudinal axis of the housing of the neutron source is parallel, especially coaxial, to the beam axis and the proton beam may enter the neutron source through the opening.

When the activation area of the first reflector-moderator comprises a bore and at least one activation channel, the neutron activation system may further comprise a supplying device for loading the material to be activated, the supplying device being connected to the activation channel.

According to a third aspect, the invention proposes a method for neutron activation of a material, the method implementing the neutron activator as previously defined, the method comprising the steps consisting in:

loading the material in the activation area of the first reflector-moderator, emitting a proton beam along the longitudinal axis of the housing of the neutron source through the opening, on the upstream surface of plate of the metallic target so as to interact with the plate and produce neutrons, the proton beam having an energy comprised between about 16 MeV and about 30 MeV, preferably about 30 MeV, and having a proton intensity above 1 mA up to 1.5 mA, cooling the metallic target.

The method may be implemented for producing radioisotopes, preferably radiopharmaceuticals. For example, said radioisotope may be a $\beta^-$ emitting radioisotope suitable for Nuclear Medicine applications, preferably $^{166}$Ho, $^{186}$Re, $^{188}$Re, $^{177}$Lu, $^{198}$Au, $^{90}$Y, $^{227}$Ra and $^{161}$Tb.

In another specific embodiment of the method, said material to be activated may be contained within or in the form of a microparticle or nanoparticle, for example of Holmium-oxide micro/nanoparticles. Typically, the micro/nanoparticles may be in a liquid suspension.

In a specific embodiment, said material may be contained in a capsule, and said capsule may be placed at the activation area by moving the capsule within an activation channel embedded in the reflector-moderator.

BRIEF DESCRIPTION OF THE DRAWINGS

Other objects and advantages of the invention will be understood more clearly with the following detailed description of a preferred but non-limiting embodiment. This detailed description is given with reference to the attached drawings, in which.

DETAILED DESCRIPTION

Figure 1:
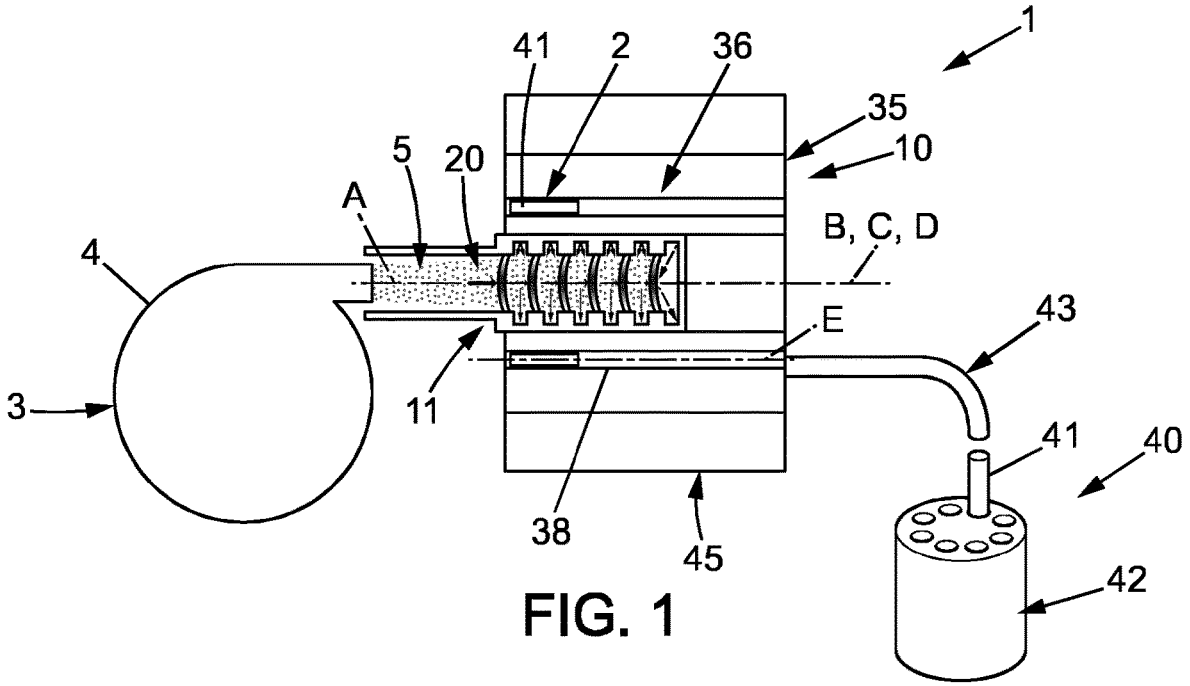
FIG. 1 is a schematic illustration of the neutron activation system according to an embodiment of the invention, the neutron activation system comprising a generator configured to produce a proton beam along a beam axis, a neutron activator arranged to receive the proton beam, and a supplying device for loading samples of a material to be activated by neutrons produced by the neutron source.

FIG. 1 represents an embodiment of a neutron activation system 1 for neutron activation of a material 2. Although not limited thereto, the neutron activation system 1 finds particular applications in production of radioisotopes, preferably radiopharmaceuticals, such as a $\beta^-$ emitting radioisotope suitable for Nuclear Medicine applications, preferably $^{166}$Ho, $^{186}$Re, $^{188}$Re, $^{177}$Lu, $^{198}$Au, $^{90}$Y, $^{227}$Ra and $^{161}$Tb.

In a specific embodiment, the material to be activated is contained within or in the form of micro- or nano-particles, for example of Holmium-oxide micro- or nano-particles, possibly in a liquid suspension. Examples of Holmium-oxide particles are described in "New modality of curietherapy with holmium oxide submicronic particles." EANM 2009, Annual Congress of the European Association of Nuclear Medicine", Oct. 10-14, 2009, Barcelona, Spain.

In the represented embodiment, the neutron activation system 1 comprises:

a generator 3, such as a cyclotron 4, configured to produce a proton beam 5 along a beam axis A, the proton beam 5 having an energy comprised between about 16 MeV and about 30 MeV, preferably of about 30 MeV, and a proton intensity above 1 mA up to 1.5 mA, a neutron activator 10 configured to produce neutrons from an interaction with the proton beam 5 so as to activate the material 2 to be activated, and a supplying device 40 for loading one or more samples of material 41 to be activated.

The neutron activator 10 according to the invention advantageously provides an optimized flux of neutrons having an energy of interest in a localized activation area 36 around the samples of material 41, while remaining sufficiently compact for its use with small to medium sized cyclotron 4. It is therefore appropriate to perform a routine and industrial production of activated doses of radioisotopes, for use in pre-clinical and clinical studies, as well as for product commercialization.

Figure 2:
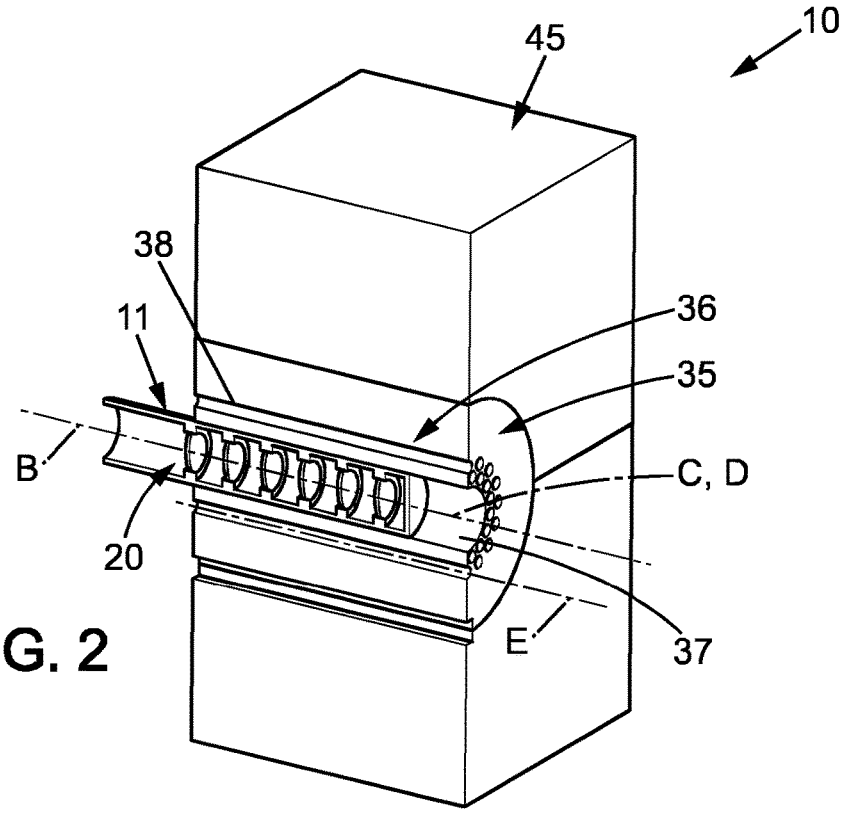
FIG. 2 is an enlarged schematic illustration of the neutron activator of the neutron activation system of FIG. 1, the neutron activator comprising a neutron source, a first reflector-moderator accommodating the neutron source, and a second reflector-moderator housing the first reflector-moderator.

As shown on FIG. 2, the neutron activator 10 comprises:

a neutron source 11 comprising a metallic target 20 configured to produce neutrons through the interaction with the proton beam 5, a cooling circuit 25 configured to cool the metallic target 20, a first reflector-moderator 35 including the activation area 36 configured to accommodate the neutron source 11 and the samples of material 41, and a second reflector-moderator 45 housing the first reflector-moderator 35.

The Neutron Source 11

Figure 3:
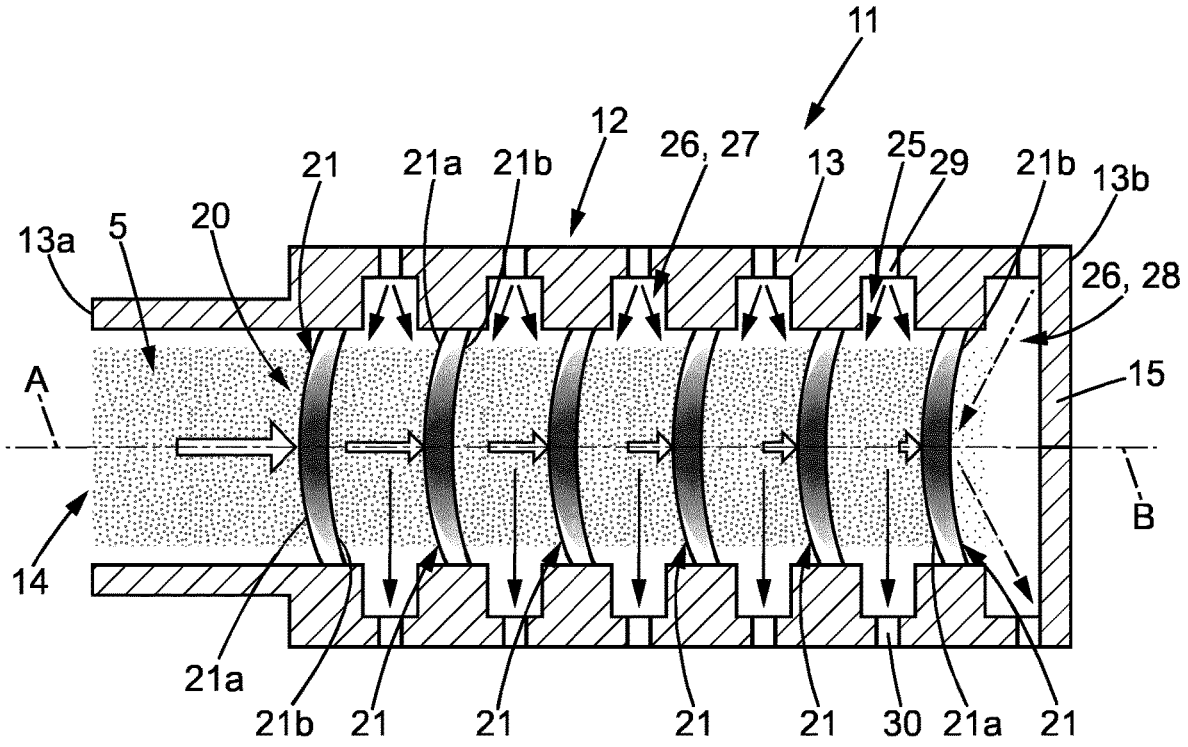
FIG. 3 is an enlarged schematic illustration of the neutron source of the neutron activator of FIG. 2.

The neutron source 11, shown in details on FIG. 3, comprises a housing 12 in which the metallic target 20 is arranged.

The housing 12 comprises a lateral wall 13 that is cylindrical of circular cross-section around a longitudinal axis B. The lateral wall 13 presents a first end 13*a* defining an opening 14, and a second end 13*b* opposite the first end 13*a*. The housing 12 further comprises an end wall 15 extending transversally with respect to the longitudinal axis B at the second end 13*b* of the lateral wall 13.

As shown on FIG. 1, in use in the neutron activation system 1, the housing is arranged so that its longitudinal axis B is parallel to the beam axis A of the proton beam 5 and its opening 14 is directed towards the cyclotron 4 so that the proton beam 5 may enter the housing 12 through the opening 14. In particular, in the represented embodiment, the longitudinal axis B of the housing and the beam axis A of the proton beam 5 are coaxial. In other embodiments, the longitudinal axis B of the housing and the beam axis A of the proton beam 5 could be parallel while being spaced apart from each other.

The metallic target 20 is configured to allow an efficient and optimized neutron production combined with good thermo-mechanical properties.

In the embodiment represented on FIGS. 1 to 3, the metallic target 20 comprises a series of six plates 21, each having a form of a disk with a circular contour. An outer edge of each plate 21, defining its contour, is secured to an inner surface of the lateral wall 13 of the housing 12 so that the plate 21 is centered on the longitudinal axis B with its contour arranged transversally, in particular perpendicularly, with respect to the longitudinal axis B of the housing 12. The plates 21 are parallel to each other.

In particular, the material of the plates 21 comprises Beryllium and/or Tantalum. The material of the plates is preferably chosen between Beryllium or Tantalum.

Each plate 21 is curvated with an upstream surface 21*a*, directed towards the opening 14 of the housing 12, that is convex and a downstream surface 21*b*, opposite the upstream surface 21*a*, that is concave.

A thickness of the plate 21, measured between its upstream 21*a* and downstream 21*b* surfaces, may be comprised between 50 μm and 1 mm. For example, the thickness of the first plate 21, also called "window" in the art, which is the closest to the opening 14, may be 0.3 mm, the thickness of the four next plates 21, with respect to the direction of the proton beam 5, may be 0.8 mm and the thickness of the last plate 21, facing the end wall 15 of the housing 12, is 0.4 mm.

The plate 21 has a transverse dimension measured perpendicularly to the longitudinal axis B, namely a diameter in the present case of a disk, preferably comprised between 30 mm and 60 mm, for example of 50 mm.

The plate 21 preferably has a radius of curvature of at least half the transverse dimension.

The cooling circuit 25 is configured to circulate a flow of cooling fluid 26 transversally with respect to the longitudinal axis B along at least the downstream surface 21*b* of the plates 21 of the metallic target 20. On FIG. 3, the cooling circuit 25 comprises:

- inlet channels 29 arranged to convey the cooling fluid 26 between the upstream 21*a* and downstream 21*b* surfaces facing each other of respective adjacent plates 21 as well as between the end wall 15 of the housing 12 and the downstream surface 21*b* of the last plate 21,
- outlet channels 30 for removing the cooling fluid 26.

In particular, the flow of cooling fluid 26 is a flow of gas 27, preferably helium, between the upstream 21*a* and downstream 21*b* surfaces facing each other of respective adjacent plates 21. The flow of cooling fluid 26 is a flow of liquid 28, preferably water, between the end wall 15 of the housing 12 and the downstream surface 21*b* of the last plate 21. A flow of liquid, such as water, used for cooling the last plate 21 enables to limit the thermal stress and thus important deformation of the plate 21 that may cause mechanical weaknesses or cracking while receiving the last high energy part of the proton beam, namely the Bragg Peak, and playing an additional role of neutron production and moderation thus optimizing the neutron flux within the activation area.

Cooling areas are therefore formed on the upstream 21*a* and downstream 21*b* surfaces of the plates 21, except for the upstream surface 21*a* of the window (first plate 21) to which vacuum is applied as it is directly connected to the proton beam generator working under vacuum conditions.

The distance between adjacent plates 21 is sized in order to obtain along the upstream 21*a* and downstream 21*b* surfaces of the plates 21 an optimized velocity distribution of the cooling fluid 26. The distance is, for example, of 0.2 mm.

In a specific embodiment, thermocouples may be attached to the plates 21, for example, on the outer edge, for monitoring the thermal status of the plates 21.

The arrangement of the plates 21 and of the cooling circuit 25 optimizes a yield of neutrons reaching the activation area 36 surrounding the metallic target 20. In particular, the metallic target 20 split in a series of plates 21 of a thickness below 1 mm each cooled with a cooling fluid 26 advantageously dilutes the power density in the plate 21 while increasing a surface for thermal cooling when thermal energy deposition is challenging. In addition, protons of the proton beam 5 are completely stopped just after the last plate 21 in the liquid 28, preferably water, as cooling fluid 26 where neutron production and moderation occurs and where a remaining heat is easily removed. Besides, the use of gas 27 as cooling fluid 26 between the upstream 21*a* and downstream 21*b* surfaces facing each other of respective adjacent plates 21 is convenient since the proton beam 5 interacts in a negligible way with low atomic weight of the particle of gas 27, such as helium or argon, thereby further promoting neutron production coming from the interaction of the metallic target 20 with the proton beam 5. This allows to significantly reduce the power density in the metallic target 20 and to improve the metallic target 20 thermal conditions, without significantly reducing the neutron production.

The invention is not limited to the embodiment of the neutron source 11 disclosed previously. In particular, the metallic target could comprise only one plate, in which case the cooling circuit is configured to circulate only a flow of liquid along the downstream surface of the plate, or any other number of plates configured in any other suitable manner. Also, any other suitable arrangement of the plates with respect to the proton beam 5 could be provided. For example, the arrangement of the plates could be adapted to a proton beam rotating around a central axis of each plate in order to dilute the power density in the plate.

In particular, the neutron source 11 could present any other configuration in which, as in the disclosed embodiment, stresses generated by temperature gradients remain within the elastic limit and protons of the proton beam 5 are completely stopped just after the last plate 21 in the cooling fluid 26 where neutron production and moderation occurs and where the remaining heat deposition is easily removed.

Preferably, the neutron source 11 may present any configuration in which, as in the disclosed embodiment, at least 50% of the energy coming from the interacting protons is lost outside the metallic target 20 as compared to the energy deposited inside the metallic target 20 if this one would have a thickness where all the protons received from the proton beam 5 released their thermal energy inside it.

In such embodiment, the neutron source 11 may present any configuration in which, as in the disclosed embodiment, the thicknesses, curvature radii and number of plates 21 are optimized so that the power density is preferably reduced to at least 50% as compared to the power density in a unique plate 21 with such thickness that all the protons would release their thermal energy inside the plate 21.

Additionally, the neutron source 11 may present any configuration in which, as in the disclosed embodiment, the thicknesses, curvature radii and number of plates is determined so that the number of generated neutrons in the target is at least 70% equal to the number of generated neutrons in the metallic target 20 where all the protons received from a proton beam 5 would release their thermal energy inside the metallic target 20.

Alternatively, the neutron source 11 may present any configuration in which the thicknesses, curvature radii and number of plates 21 could be optimized so that (i) the protons received from the proton beam 5 lose all their energy within the metallic target 20, and (ii) the stresses generated by the temperature gradients in the target remain within the elastic limit of the metallic target 20.

Figure 4:
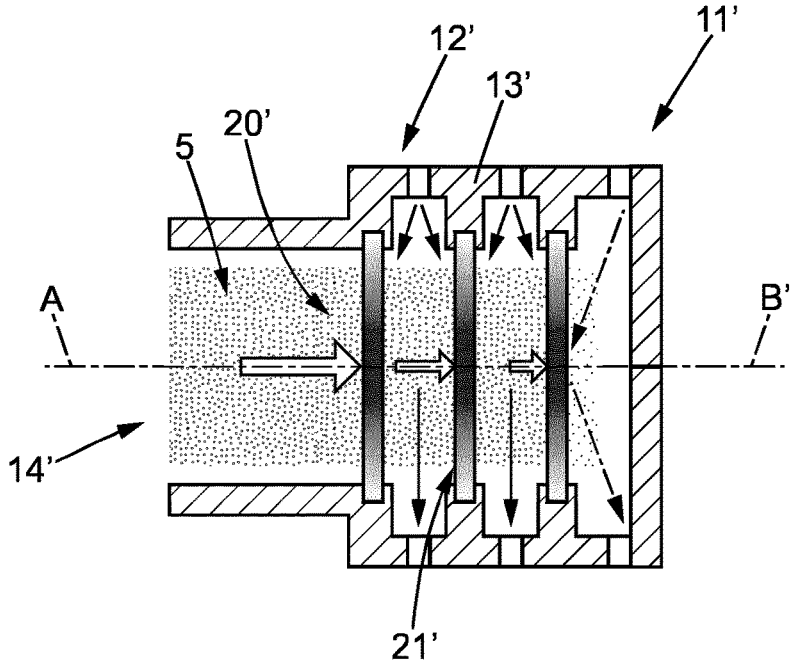
FIG. 4 is an enlarged schematic illustration of a variant of the neutron source of the neutron activator of FIG. 2.

For example, FIG. 4 illustrates a variant of the neutron source 11' of the neutron activator 10. This variant differs from the embodiment disclosed previously in that the metallic target 20' three plates 21' with respective plan upstream 21*a* and downstream 21*b* surfaces perpendicular to the longitudinal axis B' of the housing 12'. The other features of the neutron source 11' according to the variant are analogous to that previously disclosed.

The First Reflector-Moderator 35

The function of the first reflector-moderator 35 is to concentrate the produced neutrons by reflecting them in the activation area 36 containing the samples of material 41 while efficiently slowing-down (moderating) the neutrons down to energies suitable for the activation of the selected isotopes.

In the represented embodiment, the first reflector-moderator 35 is generally cylindrical along a central axis C, especially of circular cross-section, and presents dimensions set to maximize the activation yield of the isotopes while keeping it as small as possible.

The first reflector-moderator 35 is preferably made of a material comprising Beryllium. In an advantageous embodiment, the first reflector-moderator 35 is made of Beryllium, namely it contains at least 90% of Beryllium metal. The use of Beryllium presents the following advantages compared with other materials:

- it presents a good capacity for containing the neutrons in some defined spectra, and thereby an improved activation efficiency in the activation area 36,
- it is more adapted for activating the radioisotopes of interest, mainly Holmium particles,
- it allows low activation dose rate of this specific reflector thus promoting the maintenance operations.

The activation area 36 of the first reflector-moderator 35 comprises a bore 37 extending along a bore axis D that is, in the represented embodiment, coaxial to the central axis C of the first reflector-moderator 3. The bore 37 is configured to accommodate the neutron source 11 so that the bore axis and the longitudinal axis B are coaxial.

The activation area 36 of the first reflector-moderator 35 also comprises one or several activation channels 38 extending along a channel axis E parallel to the bore axis D at the vicinity of the bore 37. In particular, the activation area 36 comprises activation channels 38 distributed around the bore 37. For example, in the represented embodiment, a first series of activation channels 38 are evenly distributed around the bore 37 at a first distance from the bore axis D and a second series of activation channels 38 are evenly distributed around the bore 37 at a second distance from the bore axis D, greater than the first distance.

The activation channels 38 are configured to load the samples of material 41 to be activated. In this respect, the activation channels 38 each have an inlet connected the supplying device 40 arranged at a remote location from the first reflector-moderator 35. The supplying device 40 is configured to move the samples of material 41, in the form of capsules housing the material to be activated:

- from a shielded capsule loader 42 towards the activation channels 38 through a transfer system 43 connecting the capsule loader 42 and the activation channels 38, and
- after activation has occurred, from activation channels 38 towards a collection device.

Although not limited thereto, the supplying device 40 may implement a pneumatic system enabling the samples of material 41 to be moved back and forth, especially so as to be loaded within or unloaded from the activation channels 38, through application of appropriate flows of compressed air. The pneumatic system may also enable a cooling of the activation area 36, by means of the flow of compressed air in the activation channels 38, to remove the heat generated by the interactions of the neutrons with the samples of material 41 during activation.

The Second Reflector-Moderator 45

The second reflector-moderator 45 houses the first reflector-moderator 35 and aims at further slowing down and scattering back the neutrons, already partially moderated, escaping from the first reflector-moderator 35. Its main purpose is to optimize the activator performances while minimizing the volume, and therefore the cost, of the very expensive first reflector-moderator 35.

Preferably, the second reflector-moderator 45 is made of polyethylene, typically high-density polyethylene. The dimensions of the moderator will be such that the whole neutron activator 10, including the neutron source 11 with its metallic target 20, the cooling circuit 25, the first 35 and second 45 reflector-moderators does not exceed a volume of a cube of 1 meter side, preferably 0.75 meter side, and for example 0.50 meter side.

Method for Neutron Activation

The above disclosed neutron activation system 1 may be implemented in a method for neutron activation of a material.

The method comprises a step consisting in loading the material in the activation area 36 of the first reflector-moderator 35. One or several samples of material 41, in the form of capsules containing micro- or nano-particles of stable targeted isotopes, are loaded in one or several activation channels 38.

The method comprises a step consisting in causing the cyclotron 4 to emit the proton beam 5 having an energy comprised between about 16 MeV and about 30 MeV, preferably about 30 MeV, and having a proton intensity above 1 mA and up to 1.5 mA. The proton beam 5 is emitted along the longitudinal axis B of the housing 12 of the neutron source 11 through the opening 14, on the upstream surface 21*a* of the window (first plate 21) of the metallic target 20, and propagates towards the following plates 21 until it is completely stopped just after the last plate 21 in the liquid 28, as previously explained. The interaction of the plates 21 of the metallic target 20 with the proton beam 5 generates fast (high energy) neutrons.

Meanwhile, the metallic target 20 is cooled through the flows of gas, preferably helium, and liquid, preferably water, between inlet 29 and outlet 30 channels of the cooling circuit 25. For example, the flow of gas has a static pressure comprised between 1 bar and 10 bars and reaches, near the upstream 21*a* and downstream 21*b* surfaces of the plates, speeds comprised between 200 m/s and 500 m/s between adjacent plates 21. For the last plate 21, the downstream surface 21*b* is cooled by the flow of liquid at a static pressure comprised between 1 bar and 20 bars and reaches, near the downstream surface 21*b*, speeds comprised between 8 m/s and 60 m/s. The cooling aims at reducing thermal stresses on the plates 21 and, for the last plate 21, avoiding boiling of the water while limiting erosion effects on the downstream surface 21*b* or vibration of the metallic target 20.

The neutrons are reflected and moderated by the first reflector-moderator 35 and further moderated and scattered back by the second reflector-moderator 45.

The samples of material 41 within the activation area 36 are thereby activated.

The method presents at least the following advantageous effects:

- it is possible to activate the particles in injectable form, which is hardly achievable with a nuclear reactor, the use of a dedicated cyclotron-driven system allows a more flexible production and distribution of activated radioisotopes, no particles damage due to γ-heating (typical of nuclear reactors) occurs, short-half-life isotopes can be used and repeated treatment can be planned to increase the therapeutic efficiency, different types and sizes of micro or nanoparticles can be used to tailor the therapy method to the specific case.

EXAMPLE

In a non-limitative example, the neutron activation system 1 as previously described is used for producing radioisotopes, preferably for use in radiopharmaceuticals and medical devices.

The choice of the radioisotopes depends on three main characteristics: the half-life, the $\beta^-$ energy and the γ energy (see Table 1 below). Shorter half-life allows shorter permanence period in the treating unit (repeated treatment possible). Higher $\beta^-$ energy corresponds to higher therapeutic efficiency. Higher γ energy corresponds to better detection with Single photon emission computed tomography (SPECT).

TABLE 1

| Radioisotope | Half-life | $\beta^-$ energy(keV) | γ energy (keV) |
|---|---|---|---|
| Holmium 166 | 26.7 hours | 1840 | 80 |
| Lutetium 177 | 6.7 days | 497 | 208 |
| Rhenium 186 | 3.7 days | 1077 | 137 |
| Rhenium 188 | 17 hours | 2100 | 155 |
| Yttrium 90 | 2.7 days | 2080 | No |
| Gold 198 | 2.7 days | 1372.9 | 411.8 |
| Terbium 161 | 6.9 days | 157.4 | 74.5 |

In a specific embodiment, the radioisotope is a $\beta^-$ emitting radioisotope suitable for Nuclear Medicine applications, preferably $^{166}$Ho, $^{186}$Re, $^{188}$Re, $^{177}$Lu, $^{198}$Au, $^{90}$Y, $^{227}$Ra and $^{161}$Tb.

Holmium is of particular interest for the application of the present invention as it represents a very good compromise combining a short half-life and high $\beta^-$ energy, compared with the other radioisotopes.

The neutron activator 10 is a rectangular parallelepiped with a 50 cm width, 50 cm height, and 56 cm long. The first reflector-moderator 35 has an internal diameter of the bore 37 of Di=100 mm, an external diameter De=160 mm and a length of 200 mm.

As regards the arrangement of the activation channels 38, they are disposed on one ring placed in a concentric way around the bore axis D and composed of 16 activation channels 38 evenly distributed. Each activation channels 38 has a loading capacity of 4 capsules resulting in a total capacity of 64 capsules/doses per production run.

Table 2 presents the technical parameters of the neutron activator 10.

TABLE 2

| PARAMETER | | VALUE | RATIONALE |
|---|---|---|---|
| Beam | Beam type | Protons | Best neutron yield |
| | Beam Energy | 30 MeV | Maximize neutron yield |
| | Beam current | 1 mA | Maximize neutron yield |
| | Beam current ref distrib. | Gaussian with FWHM = 1.4431 | Ref assumption for most challenging cooling conditions, real shape to be determined |
| | Collimators diameter | 40 mm | Minimize power density |
| Target | Material | Be | Maximize neutron yield, assure resistance minimize activation |
| | Shape | Series of curvated disks | Optimize heat exchange |
| | Overall dimensions | D = 50 mm H = 100 mm | Optimize heat exchange |
| Moderator-reflector | Material | Be/PEHD/Water | Optimize neutron fluxes and spectrum |
| | Shape | cylindrical | |
| | Be moderator-reflector dimensions | height = 20 cm diameter = 16 cm | |
| | PEHD cube dimensions | 0.5 × 0.5 × 0.6 m | |
| Activation channels | Dimensions | D = 11 mm | Minimize neutron leak |
| | Number | 16 | Maximize loading capacity |
| | Capsules per channel | 1 ÷ 4 | Maximize loading capacity |
| Activation capsules | Material | PEEK/LDPE/HDPE | |
| | Dimensions | Diameter 8.5 mm Length 45 mm | |

To limit erosion effects, cooling by flows of helium and water is performed at a speed limited at around 500 m/s and 10 m/s respectively, corresponding, with the present dimensions, to a flow rate of about 17 g/s and 2 kg/s respectively. With this condition, the maximum temperature of the plates 21 at the interface with the cooling fluid 26 is expected around 210° C. for the surfaces cooled by helium and 150° C. for the surface cooled by water. To avoid boiling, the water is to be pressurized at least at 5 bars.

Table 3 summarizes the cooling characteristics for the metallic target 20.

TABLE 3

| Properties | Value |
|---|---|
| Target maximum temperature | 760° C. |
| Maximum temperature at the interface target/helium | 210° C. |
| Maximum temperature at the interface target/water | 150° C. |
| Minimum pressure needed in the cooling water system | 5 bar |
| Mass flow rate for helium coolant | 17 g/s |
| Mass flow rate for water coolant | 2 kg/s |

With the neutron activator 10 according to the Example, the $^{166}$Ho activation yield is presented in table 4.

TABLE 4

| Reflector-moderator | Saturation Activity (Bq/g/uA) |
|---|---|
| Beryllium | 3.5E+08 |

The invention claimed is:

1. A neutron activator for neutron activation of a material, the neutron activator being configured to produce neutrons from an interaction with a proton beam emitted along a beam axis, the proton beam having an energy comprised between about 16 MeV and 30 MeV and a proton intensity above 1 mA and up to 1.5 mA, the neutron activator comprising:

a neutron source comprising:

a housing extending along a longitudinal axis intended to be arranged parallel to the beam axis, the housing presenting an opening through which the proton beam may enter the neutron source, and a metallic target configured to produce neutrons through the interaction with the proton beam, the metallic target comprising a plurality of adjacent plates, each arranged transversally with respect to the longitudinal axis, the plates being arranged parallel to each other and centered on the longitudinal axis, each plate presenting an upstream surface directed towards the opening of the housing and a downstream surface opposite the upstream surface, a cooling circuit configured to cool the metallic target, a reflector-moderator including an activation area configured to accommodate the neutron source and the material to be activated.

2. The neutron activator of claim 1, wherein each plate of the metallic target is a disk having a circular contour.

3. The neutron activator according to claim 1, wherein each plate of the metallic target is curvated, the upstream surface being convex and the downstream surface being concave.

4. The neutron activator according to claim 3, wherein each plate of the metallic target has a transverse dimension measured perpendicularly to the longitudinal axis and a radius of curvature of at least half the transverse dimension.

5. The neutron activator according to claim 3, wherein each plate of the metallic target has a thickness measured between the upstream and downstream surfaces comprised between 50 μm and 1 mm.

6. The neutron activator according to claim 1, wherein the cooling circuit is configured to circulate a flow of cooling fluid transversally with respect to the longitudinal axis along at least the downstream surface of each plate of the metallic target.

7. The neutron activator according to claim 6, wherein the housing of the neutron source comprises a lateral wall extending around the longitudinal axis between a first end defining the opening and a second end opposite the first end, and an end wall extending transversally with respect to the longitudinal axis at the second end of the lateral wall, the cooling circuit being configured to circulate a flow of liquid as cooling fluid between the end wall of the housing and the downstream surface of the plate facing the end wall.

8. The neutron activator according to claim 6, wherein the cooling circuit is configured to circulate a flow of gas as cooling fluid between the downstream and upstream surfaces facing each other of respective adjacent plates.

9. The neutron activator according to claim 1, wherein the activation area of the reflector-moderator comprises:

a bore extending along a bore axis and configured to accommodate the neutron source so that the bore axis and the longitudinal axis are coaxial, and at least one activation channel extending along a channel axis parallel to the bore axis at the vicinity of the bore, the activation channel being configured to load the material to be activated.

10. The neutron activator according to claim 9, wherein the activation area comprises a plurality of activation channels distributed around the bore.

11. The neutron activator according to claim 1, further comprising an additional reflector-moderator housing the reflector-moderator.

12. A neutron activation system for neutron activation of a material, comprising:

a generator configured to produce a proton beam along a beam axis, the proton beam having an energy comprised between about 16 MeV and about 30 MeV and a proton intensity above 1 mA and up to 1.5 mA, a neutron activator according to claim 1 arranged so that the longitudinal axis of the housing of the neutron source is parallel to the beam axis and the proton beam may enter the neutron source through the opening.

13. The neutron activation system according to claim 12, wherein the activation area of the reflector-moderator comprises:

a bore extending along a bore axis and configured to accommodate the neutron source so that the bore axis and the longitudinal axis are coaxial, and at least one activation channel extending along a channel axis parallel to the bore axis at the vicinity of the bore, the activation channel being configured to load the material to be activated; and further comprising a supplying device for loading the material to be activated, the supplying device being connected to the activation channel.

14. A method for neutron activation of a material, the method implementing the neutron activator of claim 1, the method comprising the steps consisting in:

loading the material in the activation area of the reflector-moderator, emitting a proton beam along the longitudinal axis of the housing of the neutron source through the opening, on the upstream surface of plate of the metallic target so as to interact with the plate and produce neutrons, the proton beam having an energy comprised between about 16 MeV and about 30 MeV and having a proton intensity above 1 mA and up to 1.5 mA, cooling the metallic target.

15. The neutron activator of claim 1, wherein each plate is made a material comprising at least one of Beryllium and Tantalum.

16. The neutron activator of claim 1, wherein each plate is arranged perpendicularly with respect to the longitudinal axis.

17. The neutron activator of claim 1, wherein the reflector-moderator is made of a material comprising Beryllium.

18. The neutron activator according to claim 4, wherein the transverse dimension of each plate of the metallic target is comprised between 30 mm and 60 mm.

19. The neutron activator according to claim 7, wherein the cooling circuit is configured to circulate a flow of water as cooling fluid.

20. The neutron activator according to claim 8, wherein the cooling circuit is configured to circulate a flow of helium as cooling fluid.

21. The neutron activation system of claim 12, wherein the generator is configured to produce the proton beam having the energy of about 30 MeV.

22. The method of claim 14, wherein the energy of the proton beam is about 30 MeV.

* * * * *